US007643772B2

(12) United States Patent
Koshida

(10) Patent No.: US 7,643,772 B2
(45) Date of Patent: Jan. 5, 2010

(54) IMAGE FORMING APPARATUS HAVING DOOR POSITIONING DEVICE

(75) Inventor: Kohei Koshida, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/107,696

(22) Filed: Apr. 22, 2008

(65) Prior Publication Data

US 2008/0199211 A1 Aug. 21, 2008

Related U.S. Application Data

(63) Continuation of application No. 11/271,588, filed on Nov. 10, 2005, now Pat. No. 7,424,249.

(30) Foreign Application Priority Data

Nov. 12, 2004 (JP) ..... 2004-328527

(51) Int. Cl.
*G03G 15/00* (2006.01)
*G03G 21/18* (2006.01)

(52) U.S. Cl. ..... 399/110; 399/114

(58) Field of Classification Search ..... 399/110, 399/114, 124

See application file for complete search history.

(56) References Cited

U.S. PATENT DOCUMENTS 5,041,872 A * 8/1991 Nukaya et al. ..... 399/107
2006/0083543 A1* 4/2006 Sunohara ..... 399/110

FOREIGN PATENT DOCUMENTS

JP 61119567 A * 6/1986
JP 07329353 A * 12/1995

* cited by examiner

*Primary Examiner*—David M Gray
*Assistant Examiner*—Erika Villaluna
(74) *Attorney, Agent, or Firm*—Canon USA Inc IP Div

(57) ABSTRACT

An image forming apparatus includes an image forming unit, an apparatus body, a door, a sheet conveyance unit, and a positioning device. The image forming unit forms an image on a sheet. The image forming unit is disposed in the apparatus body. The door is provided in the apparatus body so as to be openable and closable. The sheet conveyance unit conveys the sheet to the image forming unit. The sheet conveyance unit is provided in the door. The positioning device positions the door in relation to the apparatus body in the vertical direction and the horizontal direction. The positioning device performs positioning of the door in the vicinity of the image forming unit.

5 Claims, 10 Drawing Sheets

IMAGE FORMING APPARATUS HAVING DOOR POSITIONING DEVICE

CROSS-REFERENCE TO RELATED APPLICATIONS

This application is a continuation of application Ser. No. 11/271,588 filed Nov. 10, 2005, which claims the benefit of Japanese Application No. 2004-328527 filed Nov. 12, 2004, all of which are hereby incorporated by reference herein in their entirety.

BACKGROUND OF THE INVENTION

1. Field of the Invention

The present invention relates to an image forming apparatus, and more specifically, it relates to a structure for opening and closing a door that is opened when a paper jam occurs.

2. Description of the Related Art

Some of the conventional image-forming apparatuses such as photocopiers, printers, facsimiles, and multifunctional devices have an apparatus body in which an image forming unit is disposed and a door provided in the apparatus body that can be opened and closed. When maintenance is performed and when a paper jam occurs, the door is opened to open up the inside of the apparatus so as to facilitate maintenance and clearing the paper jam.

For example, an image forming apparatus discussed in Japanese Patent Laid-Open No. 2004-29211 (corresponding to U.S. Application No. 2003-235430) has a door that opens downward. The door includes a part of a sheet conveyance unit that conveys a sheet to an image forming unit. When a paper jam occurs, the door is opened and thereby the sheet conveyance unit is opened widely so as to facilitate clearing the paper jam.

FIGS. 10A and 10B are side views of such a conventional image forming apparatus and illustrate a mechanism for opening and closing a door. In FIG. 10A, the door 102 is closed. In FIG. 10B, the door 102 is open.

As shown in FIGS. 10A and 10B, an image forming unit 103 is disposed in an image forming apparatus body (hereinafter referred to as "apparatus body") 100, and the door 102 is provided in the apparatus body 100 so as to be openable and closable. The door 102 is rotatable around a pivot pin 120 at the lower end. A sheet feeding cassette (not shown) is disposed at the bottom of the apparatus body 100. A sheet conveyance unit (not shown) extends vertically and conveys a sheet from the sheet feeding cassette to the image forming unit 103. The door 102 includes a part of the sheet conveyance unit.

As shown in FIG. 10B, a depression 102*b* is formed in each side surface 102*a* of the door 102. A movable hook 109 is provided on each side surface 102*a*. A movable hook 109 is rotatable around a hook shaft 110. When the door 102 is closed, first, the depression 102*b* comes into contact with a fixing pin 121 provided in the apparatus body 100. Next, as the door 102 closes, the fixing pin 121 moves along the depression 102*b* and lifts the movable hook 109. Finally, as shown in FIG. 1A, a depression 109*a* of the movable hook 109 engages with the fixing pin 121. In this way, the door 102 is locked.

The fixing pin 121 is disposed in each side of the apparatus body 100. The position of the door 102 in relation to the apparatus body 100 in the horizontal direction and the vertical direction is determined by the pivot pin 120.

In the above-described conventional image forming apparatus, the fixing pin 121 of the apparatus body 100 comes into contact with the depression 102*b* formed in the side surface 102*a* of the door 102, and then the movable hook 109 engages with the fixing pin 121. Therefore, in consideration of the variation in the position of the fixing pin 121 and in the position of the depression 102*b*, the inside diameter of the depression 102*b* needs to be larger than the diameter of the fixing pin 121.

However, in the case where the inside diameter of the depression 102*b* is larger than the diameter of the fixing pin 121, when the movable hook 109 engages with the fixing pin 121, a gap is left between the depression 102*b* and the fixing pin 121. Therefore, the door 102 cannot be positioned accurately in the vertical direction and the horizontal direction. Although the positioning in the horizontal direction is performed also by the movable hook 109, the positioning in the horizontal direction cannot be performed accurately because there is a variation also in the position of the movable hook 109.

Therefore, the positioning of the door 102 including the sheet conveyance unit in relation to the apparatus body 100 in the horizontal direction and the vertical direction is performed by the pivot pin 120.

Recently, the number of parts attached to the door 102 has increased. For example, a conveyance unit for two-sided printing is provided in the door 102. If the door 102 is composed of a small number of parts, the door 102 can be distorted due to its inadequate rigidity. It is difficult to position and align the door 102 accurately in relation to the apparatus body 100. When the rigidity of the door 102 is improved in order to prevent the distortion of the door 102, the weight of the door itself increases, and the whole door can be distorted by its own weight.

When the door 102 is distorted and the pivot pin 120 positions the door 102, the accuracy in positioning the door 102 in relation to the image forming unit 103 is lower than the accuracy in positioning the door 102 in relation to a part near the pivot pin 120 because the pivot pin 120 is away from the image forming unit 103.

When the accuracy in positioning the door 102 is low, the sheet conveyance unit in the door 102 cannot be positioned accurately in relation to the image forming unit 103 (for example, a transferring device). As a result, the sheet can skew in the sheet conveyance unit in the apparatus body 100. In such a case, a defect in the image (e.g., scattering of the image) and deterioration in image quality occur.

SUMMARY OF THE INVENTION

The present invention is directed to an image forming apparatus capable of preventing a defect in the image and deterioration in image quality.

In an aspect of the present invention, an image forming apparatus includes an image forming unit, an apparatus body, a door, a sheet conveyance unit, and a positioning device. The image forming unit is configured to form an image on a sheet. The image forming unit is disposed in the apparatus body. The door is provided in the apparatus body so as to be openable and closable. The sheet conveyance unit is configured to convey the sheet. The sheet conveyance unit is provided in the door. The positioning device positions the door in relation to the apparatus body in the vertical direction and the horizontal direction.

Further features of the present invention will become apparent from the following description of exemplary embodiments (with reference to the attached drawings).

DESCRIPTION OF THE EMBODIMENTS

Embodiments of the present invention will now be described in detail with reference to the drawings.

Figure 1:
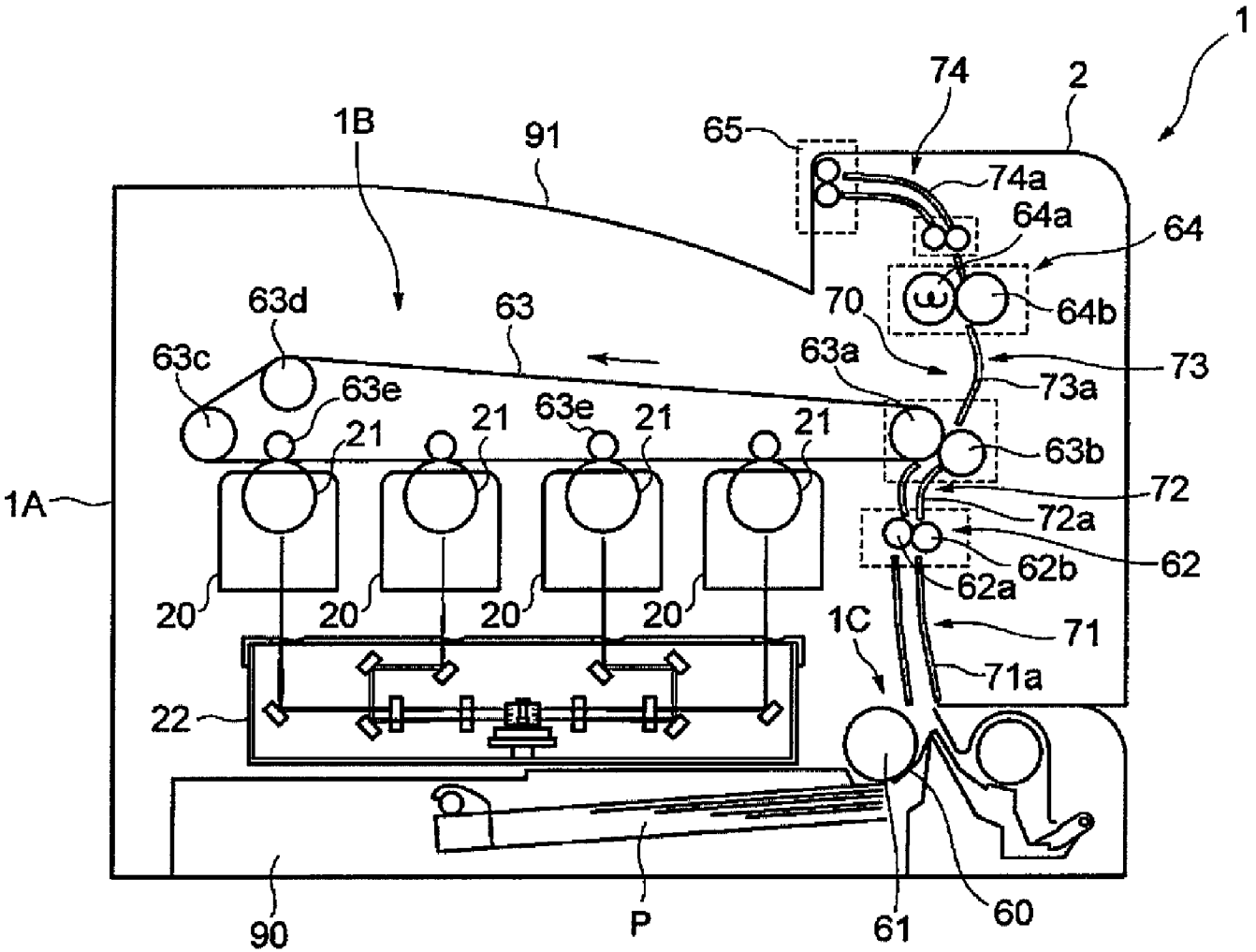
FIG. 1 illustrates the schematic structure of a color laser printer as an example of an image forming apparatus according to an embodiment of the present invention.

FIG. 1 illustrates the schematic structure of a color laser printer as an example of an image forming apparatus according to an embodiment of the present invention.

In FIG. 1, reference numeral 1 denotes the color laser printer, and reference numeral 1A denotes a color laser printer body (hereinafter referred to as "printer body"). The printer body 1A includes an image forming unit 1B, a sheet conveyance unit 1C, and a fixing device 64. The sheet conveyance unit 1C conveys a sheet P to the image forming unit 1B. The image forming unit 1B forms an image on the sheet P.

The image forming unit 1B includes four process stations 20. Four process stations 20 are arranged next to each other along a horizontal line. The four process stations 20 form yellow, magenta, cyan, and black toner images, respectively. Each process station 20 includes a photosensitive drum 21, a scanner unit 22, and a developing unit (not shown). The photosensitive drum 21 serves as an image carrier for carrying a yellow, magenta, cyan, or black toner image. The photosensitive drum 21 rotates at a constant velocity. The scanner unit 22 irradiates the photosensitive drum 21 with a laser beam according to image information so as to form a latent image thereon. The developing unit makes a yellow, magenta, cyan, or black toner adhere to the latent image on the photosensitive drum 21 so as to actualize the latent image into a toner image.

The sheet conveyance unit 1C includes a sheet feeding cassette 90, a sheet feeding roller 61, a separating pad 60, and a register roller pair 62. The sheet feeding cassette 90 is located at the bottom of the printer body 1A and contains a plurality of sheets P. The sheet feeding roller 61 takes out some sheets P from the sheet feeding cassette 90. The separating pad 60 serves for separating one sheet P from the sheets P that are taken out by the sheet feeding roller 61.

When the image forming operation is started, the sheet feeding roller 61 and the separating pad 60 send the sheets P one at a time from the sheet feeding cassette 90 to the register roller pair 62. The register roller pair 62 includes a driving register roller 62*a* and a driven register roller 62*b*. At this time, the register roller pair 62 is not moving. Therefore, the skew of the sheet P, if any, is corrected by the register roller pair 62. After correcting the skew, the register roller pair 62 starts moving. The timing when the register roller pair 62 is activated is controlled so that the leading edge of the sheet P is aligned with the leading edge of the full-color toner image formed on an intermediate transferring belt.

In FIG. 1, reference numeral 63 denotes the intermediate transferring belt. The intermediate transferring belt 63 is stretched around a driving roller 63*c*, a second transferring opposed roller 63*a*, and a tension roller 63*d*. The intermediate transferring belt 63 is rotated and driven in the direction indicated by an arrow in a synchronized manner with the circumference velocity of the photosensitive drums 21. The intermediate transferring belt 63 moves in the direction in which the process stations 20 are arranged. Four first transferring rollers 63*e* are disposed inside the intermediate transferring belt 63. The four first transferring rollers 63*e* constitute a first transferring unit. The intermediate transferring belt 63 is held between the first transferring rollers 63*e* and the respective photosensitive drums 21.

The four first transferring rollers 63*e* are connected to a power source (not shown) for applying a transferring bias. The four first transferring rollers 63*e* apply a transferring bias to the intermediate transferring belt 63. The yellow, magenta, cyan, and black toner images on the photosensitive drums 21 are transferred sequentially onto the intermediate transferring belt 63 one over another. Thus, a full-color image is formed on the intermediate transferring belt 63.

Reference numeral 63*b* denotes a second transferring roller. The second transferring roller 63*b* is disposed so as to oppose the second transferring opposed roller 63*a*. The second transferring roller 63*b* is in contact with the surface of the intermediate transferring belt 63. Being conveyed by the register roller pair 62, the sheet P is held between the intermediate transferring belt 63 and the second transferring roller 63*b* and is conveyed by them.

After being transferred onto the sheet P from the intermediate transferring belt 63, the full-color toner image is fixed on the sheet P by the fixing device 64. The fixing device 64 includes a heating roller 64*a* and a pressing roller 64*b*. In the fixing device 64, the heating roller 64*a* and the pressing roller 64*b* convey the sheet P on which the toner image is transferred. The heating roller 64*a* and the pressing roller 64*b* respectively apply heat and pressure to the sheet P, thereby fixing the toner image to the sheet P.

Next, the image forming operation of the color laser printer 1 will be described.

First, the scanner 22 irradiates the photosensitive drum with a laser beam so as to form, for example, a yellow (Y) latent image. The developing unit (not shown) develops the latent image with a yellow toner. Next, the first transferring roller 63*e* applies a voltage that is the reverse of the yellow toner to the intermediate transferring belt 63. The yellow toner image on the photosensitive drum is transferred onto the outer surface of the intermediate transferring belt 63 (a first transfer).

Similarly, magenta, cyan, and black toner images are transferred onto the outer surface of the intermediate transferring belt 63. Thus, a full-color toner image is formed on the intermediate transferring belt 63.

Concurrently with the toner image forming operation, one of the sheets P contained in the sheet feeding cassette 90 is taken out by the sheet feeding roller 61 and conveyed to the register roller pair 62 through a first conveyance guide 71. The register roller pair 62 corrects the skew of the sheet P, if any. Next, the register roller pair 62 conveys the sheet P to the nipping portion between the second transferring roller 63*b* and the intermediate transferring belt 63, through a second conveyance guide 72. The timing when the register roller pair 62 is activated is controlled so that the leading edge of the sheet P is aligned with the leading edge of the full-color toner image formed on the intermediate transferring belt 63. The sheet P is held between the second transferring roller 63*b* and the intermediate transferring belt 63 and conveyed by them.

The nipping portion between the second transferring roller 63*b* and the intermediate transferring belt 63 constitutes a second transferring unit. When the sheet P passes through the second transferring unit, a bias is applied to the second transferring roller 63*b* so as to transfer the toner image from the intermediate transferring belt 63 onto the sheet P.

After the toner image is transferred to the sheet P, the sheet P is conveyed by the second transferring roller 63*b* and the intermediate transferring belt 63 to the fixing device 64 through a third conveyance guide 73. The fixing device 64 applies heat and pressure to the sheet P to fix the toner image on the sheet P. After the image is fixed, the sheet P passes through a fourth conveyance guide 74 provided on the downstream side of the fixing device 64. The sheet P is discharged by a discharging roller pair 65 onto a discharged-sheet tray 91 provided on the upper surface of the printer body 1A.

In FIG. 1, reference numeral 2 denotes a door. The door 2 is provided at the front of the printer body 1A. The door 2 can rotate around the lower end so as to be opened and closed. In the present embodiment, the driven register roller 62*b* of the register roller pair 62, the second transferring roller 63*b*, the pressing roller 64*b*, and guide members 71*a*, 72*a*, 73*a*, and 74*a* constituting the first to fourth conveyance guides 71 to 74, are attached to the door 2.

When the door 2 is opened, a sheet conveyance path 70 composed of the first to fourth conveyance guides 71 to 74 is opened. Therefore, a sheet jam can be cleared easily.

Figure 2:
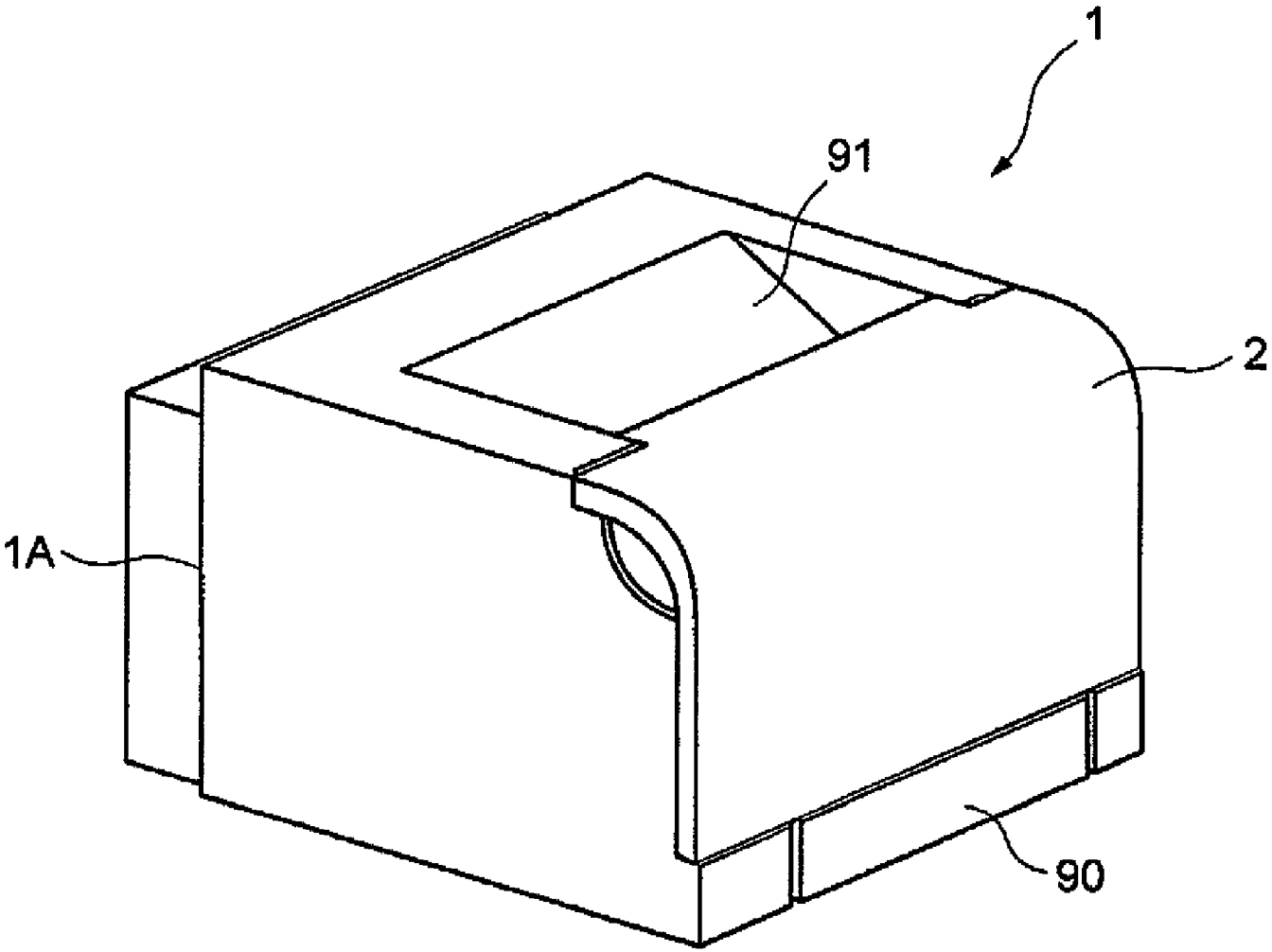
FIG. 2 illustrates a perspective view of the color laser printer with the door closed.
Figure 3A:
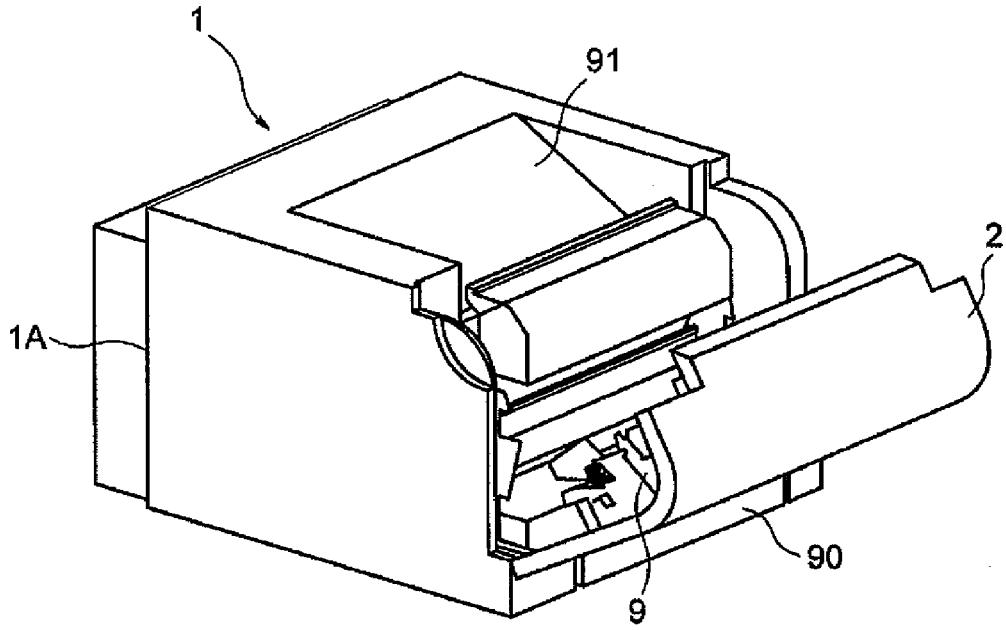
FIGS. 3A and 3B illustrate perspective views of the color laser printer with the door open.
Figure 3B:
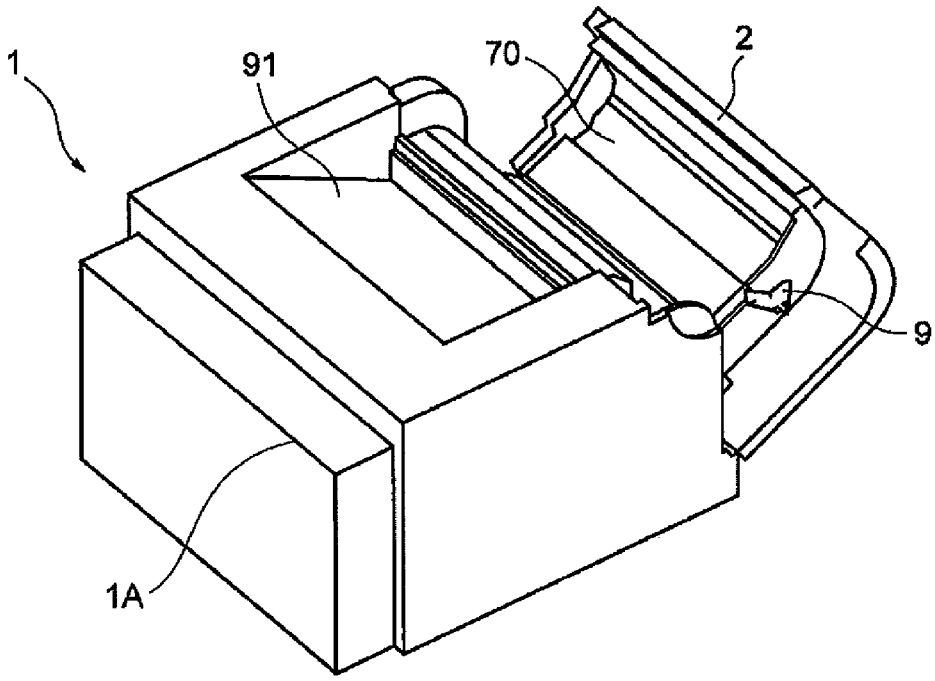

FIG. 2 illustrates the color laser printer 1 with the door 2 closed. FIGS. 3A and 3B illustrate the color laser printer 1 with the door 2 open. Opening the door 2 as shown in FIGS. 3A and 3B opens the sheet conveyance path 70 wide and makes it easy to clear a sheet jam.

Next, the mechanism for opening and closing the door 2 and the opening and closing operation will be described.

Figure 4:
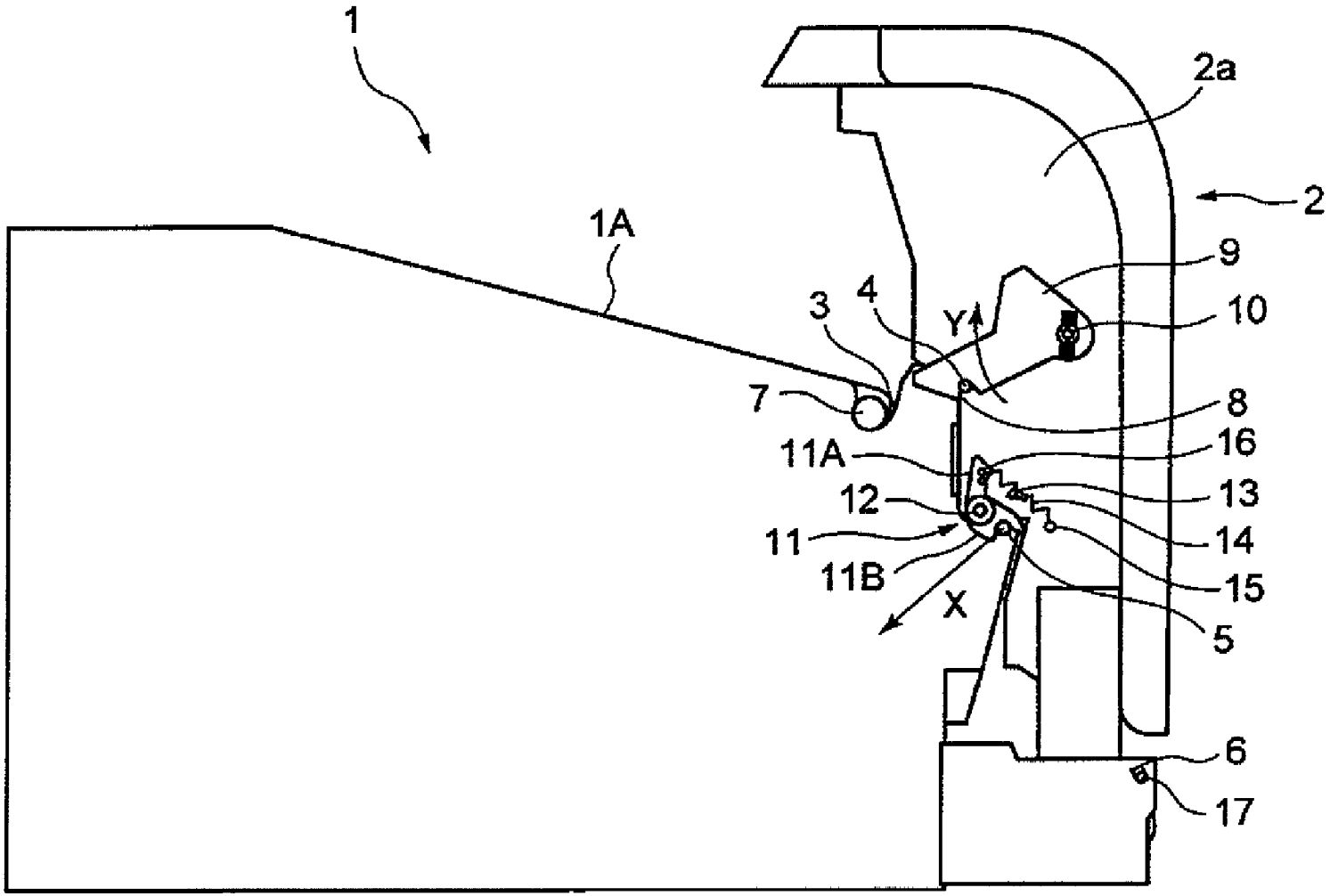
FIG. 4 illustrates a mechanism for opening and closing the door of the color laser printer.

FIG. 4 illustrates a side view of the color laser printer 1 with the door 2 closed. In FIG. 4, reference numeral 6 denotes an oblique elongated hole, and reference numeral 17 denotes a pivot pin. The elongated hole 6 is provided in each side wall of the printer body 1A. The door 2 rotates around the elongated hole 6. The pivot pin 17 is provided in each side of the lower end of the door 2. The pivot pin 17 serves as a guide shaft. Inserting the pivot pin 17 into the elongated hole 6 attaches the door 2 to the printer body 1A rotatably (so as to be openable and closable).

Reference numeral 9 denotes a movable hook. The movable hook 9 serves as a locking device that prevents the rotation (movement) of the door 2 in the opening direction. The movable hook 9 can rotate around a hook shaft 10. When the door 2 is closed, the movable hook 9 is engaged with an engaging pin 4 to prevent the door 2 from opening. The engaging pin 4 serves as an engaging device.

A coil spring member (not shown) always urges the movable hook 9 in the direction opposite to the direction shown by arrow Y, thereby keeping the movable hook 9 engaged with the engaging pin 4. A link mechanism (not shown) rotates the movable hook 9 around the hook shaft 10 in the direction of arrow Y against the coil spring member, thereby disengaging the movable hook 9 from the engaging pin 4. In this way, the door 2 is unlocked and becomes openable.

Figure 5:
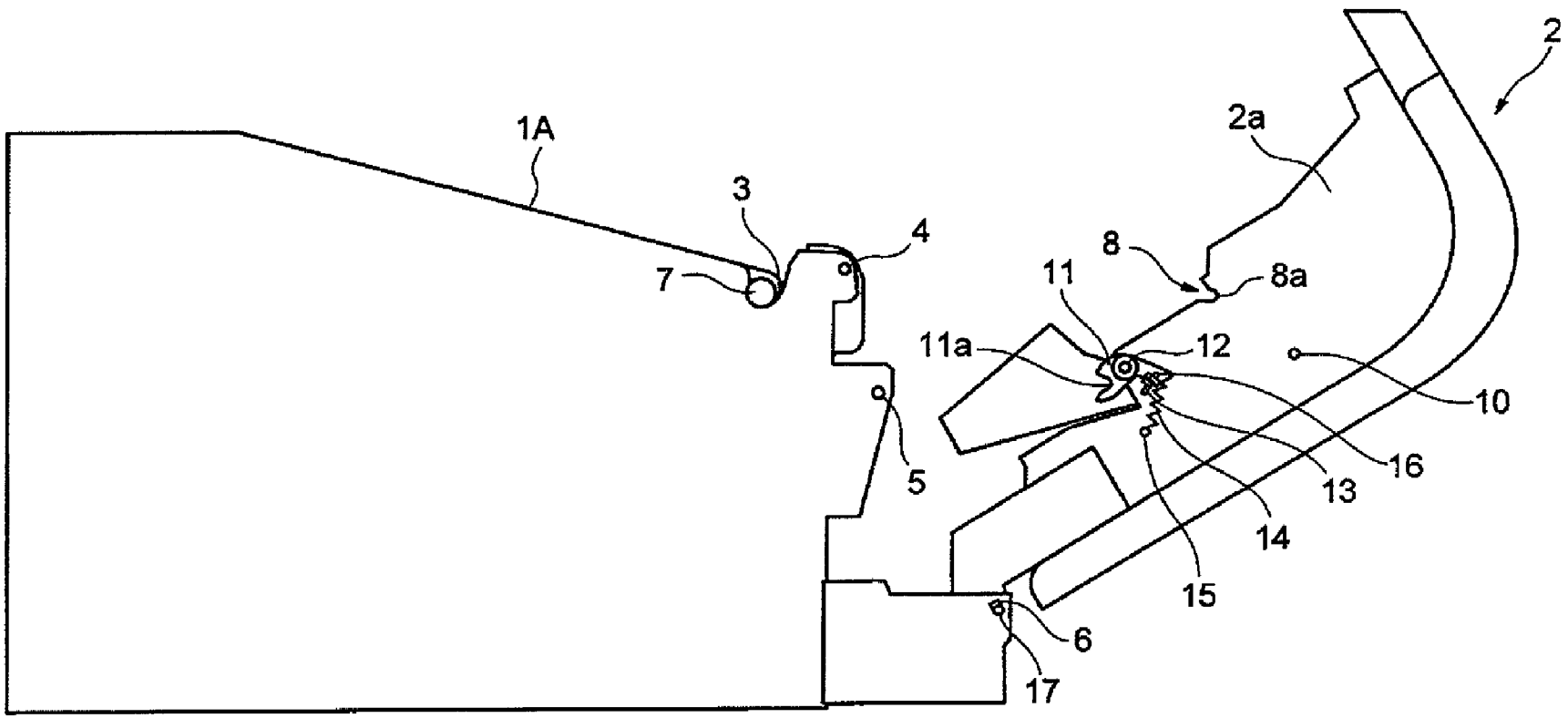
FIG. 5 illustrates the color laser printer with the door fully open.

FIG. 5 illustrates a side view of the color laser printer with the door 2 fully open. The door 2 is supported in this position by a stopper (not shown). The pivot pin 17 of the door 2 is pressed against the lower end of the elongated hole 6 by the weight of the door 2.

A rotating member 11 is provided on each side surface 2*a* of the door 2 (only one side surface is shown in FIG. 5). The rotating member 11 is located at a predetermined position on the side surface 2*a* (in the middle, in this embodiment). The rotating member 11 is supported by a rotation shaft 12 and rotatable around the rotation shaft 12. As shown in FIG. 4, the rotating member 11 includes a first arm portion 11A and a second arm portion 11B. The first arm portion 11A has a spring hole 16 for joining a coil spring 14 to the first arm portion 11A. The second arm portion 11B has a depression 11*a*.

The coil spring 14 is stretched between the spring hole 16 and a spring pin 15 of the door 2. When the door 2 is open as shown in FIG. 5, the coil spring 14 presses the rotating member 11 against a stopper 13 provided on the side surface 2*a* of the door 2. When the door 2 is closed as shown in FIG. 4, the depression 11*a* of the second arm member 11B engages with a guide pin 5 provided in the printer body 1A. The guide pin 5 serves as a guiding device.

Figure 9:
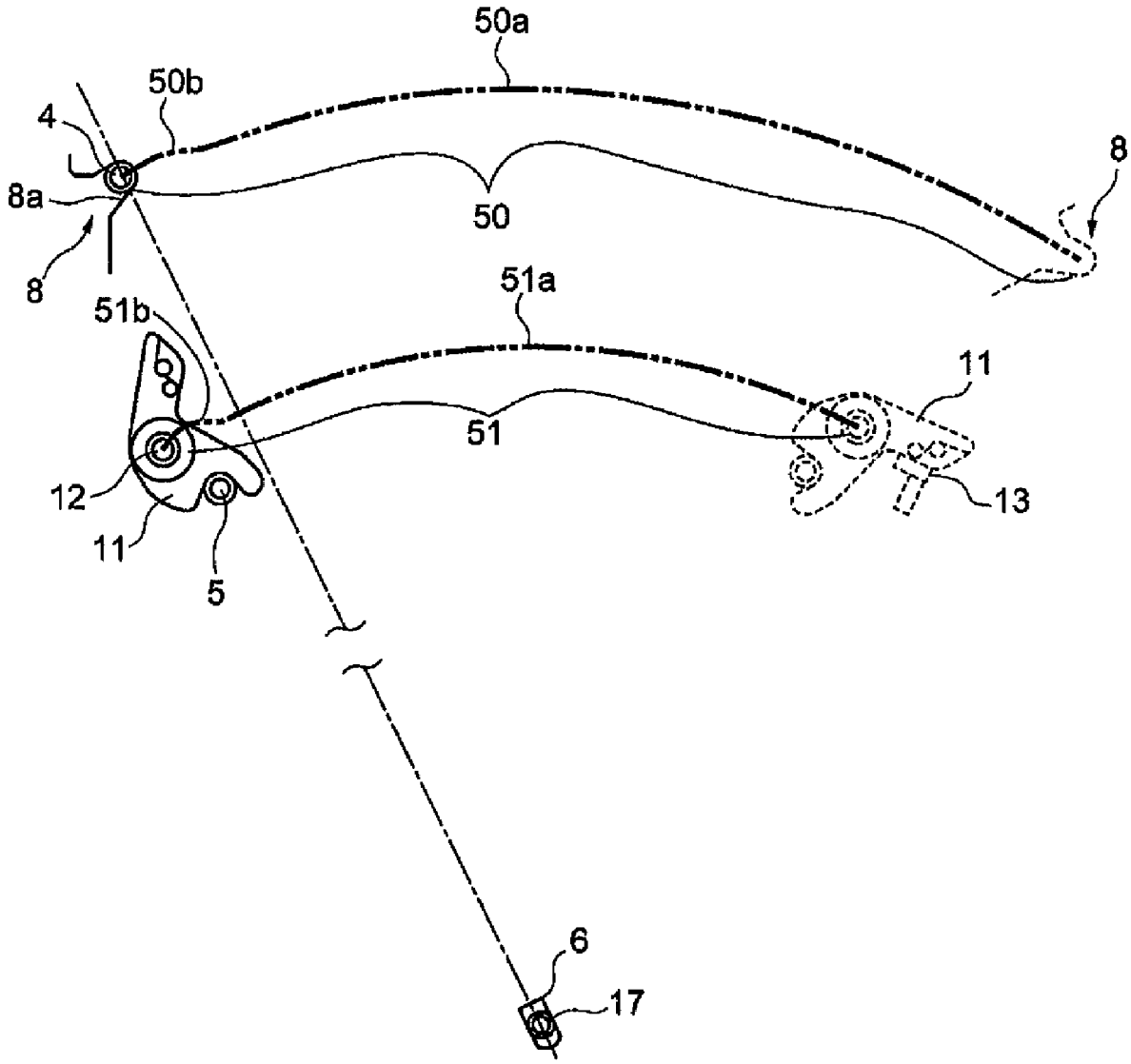
FIG. 9 illustrates the loci of a rotation shaft of a rotating member provided in the door and of an engaging portion when the door of the color laser printer is closed.
Figure 10A:
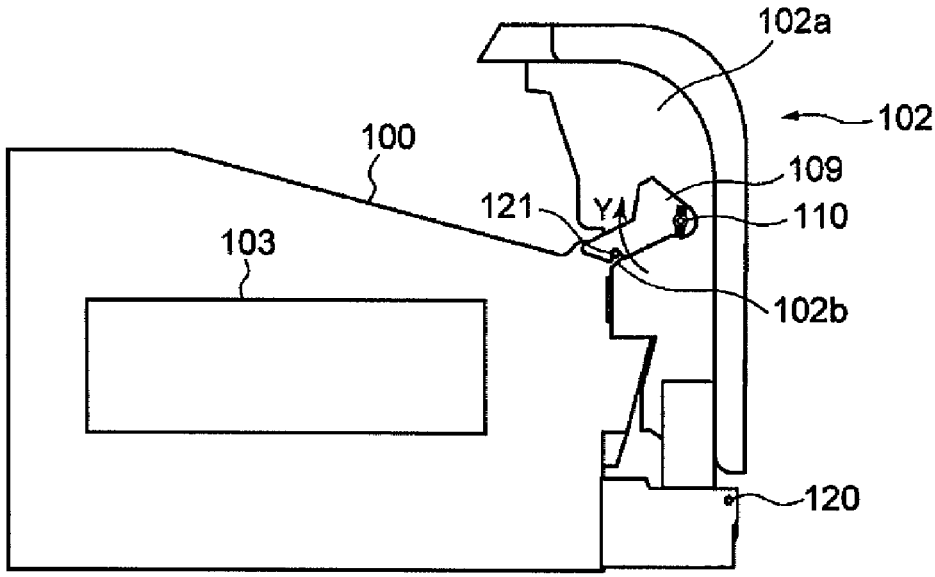
FIG. 10A PRIOR ART
FIGS. 10A and 10B are side views of a conventional image forming apparatus and illustrate a mechanism for opening and closing a door.
Figure 10B:
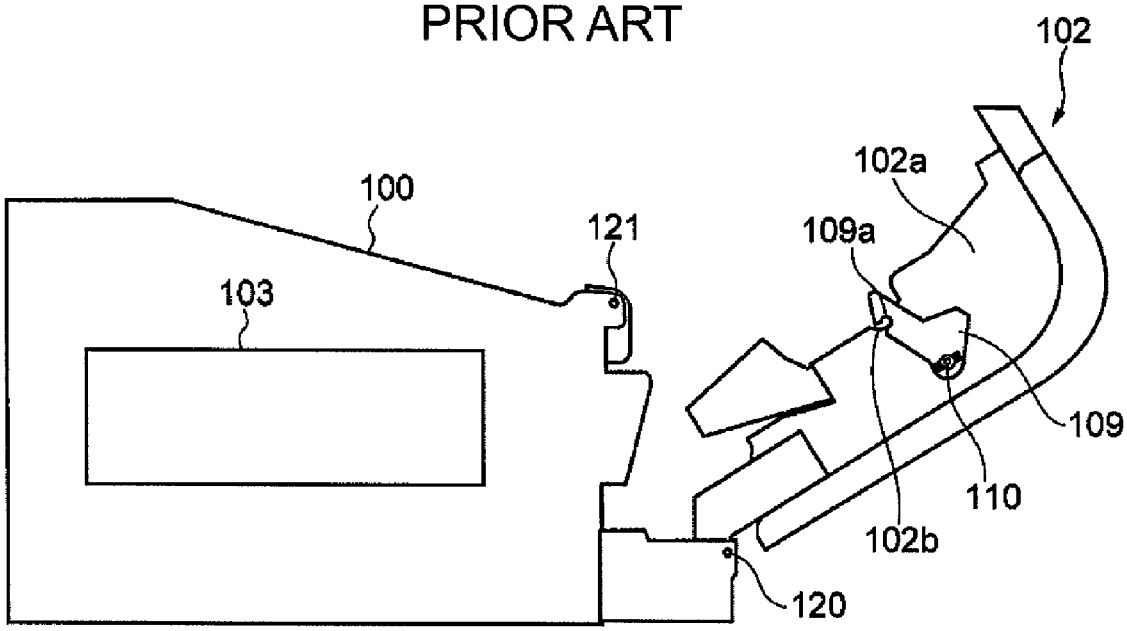
FIG. 10B PRIOR ART

As shown in FIG. 5, the door 2 has an engaging portion 8 on each side surface 2*a*, above the rotating member 11. The engaging portion 8 serves as a door engaging device. The engaging portion 8 includes a U-shaped depression 8*a*. The engaging portion 8 can engage with the engaging pin 4 of the printer body 1A. When the door 2 is closed, the U-shaped depression 8*a* of the engaging portion 8 faces obliquely downward as shown in FIG. 9. Therefore, in order to engage with the engaging pin 4, the U-shaped depression 8*a* needs to move from above obliquely towards the engaging pin 4.

In the vicinity of the engaging pin 4, a groove 3 is provided. The groove 3 serves as a transferring-unit positioning device for positioning the second transferring roller 63*b*. Fitting the roller shaft 7 of the second transferring roller 63*b* into the groove 3 positions the second transferring roller 63*b*.

The groove 3 and the engaging pin 4 are provided in the same member. Therefore, the positional relationship between the groove 3 and the engaging pin 4 is fixed. As shown in FIG. 9, the elongated hole 6 extends towards the engaging pin 4.

Next, the operation of the mechanism for opening and closing the door 2 will be described.

Figure 6A:
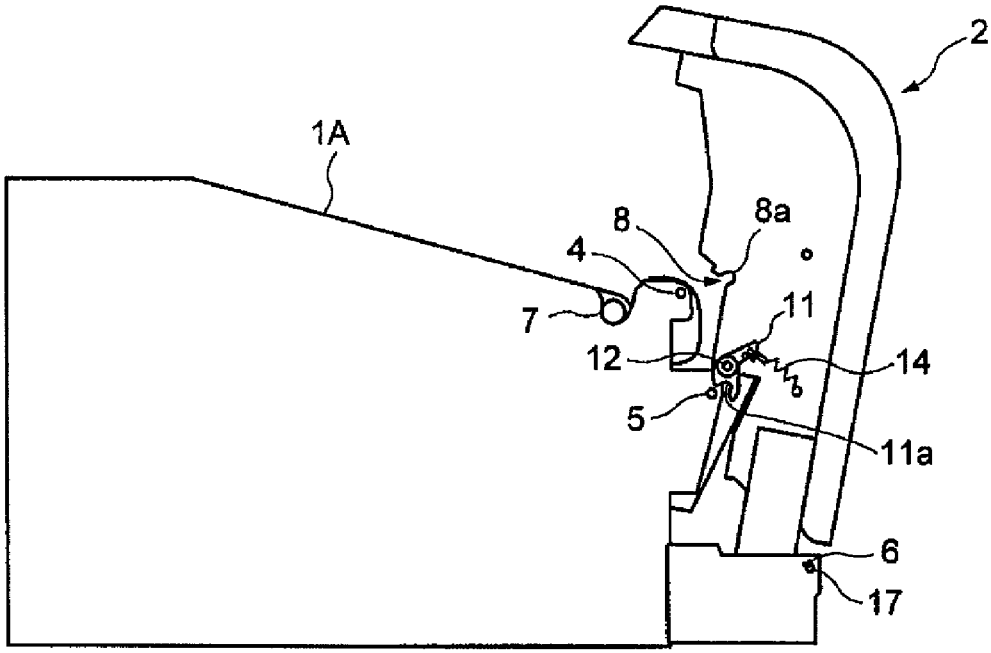
FIGS. 6A and 6B illustrate how the door of the color laser printer is closed.
Figure 6B:
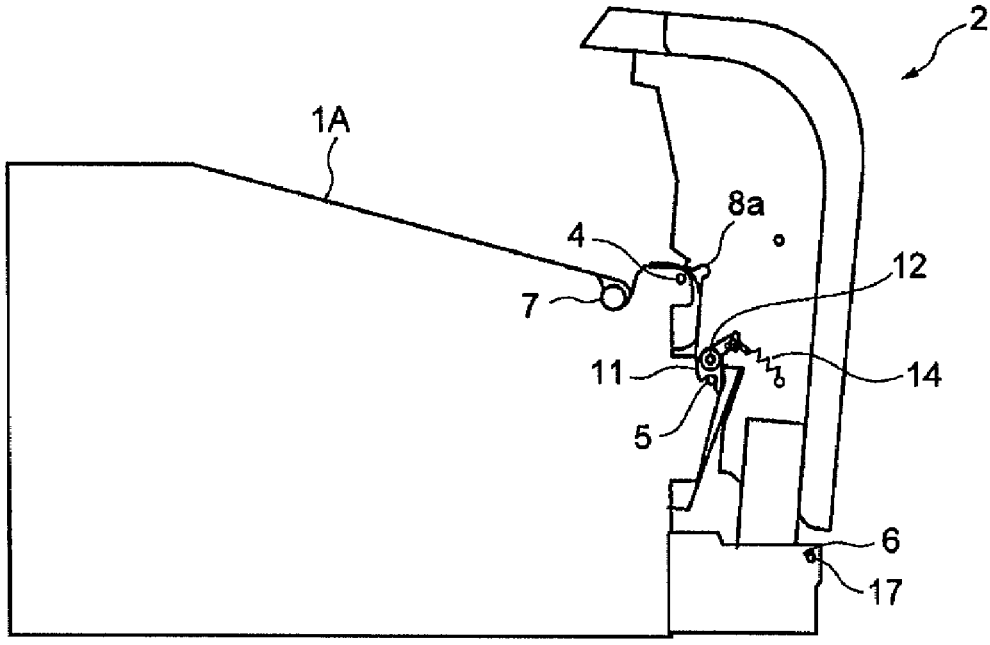
Figure 7A:
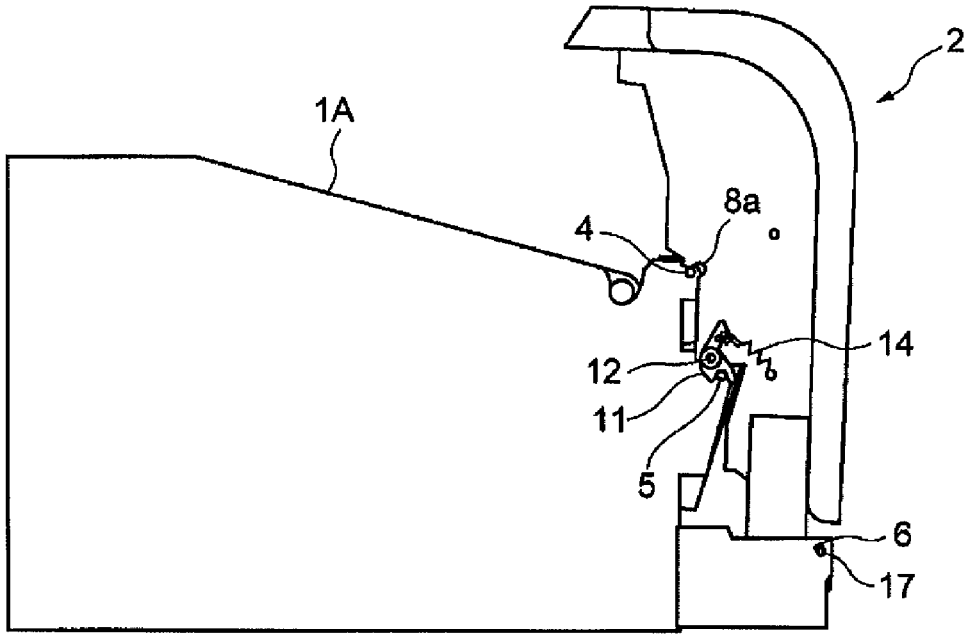
FIGS. 7A and 7B illustrate how the door of the color laser printer is closed.

Now the door 2 is open as shown in FIG. 5. The user starts to close the door 2. As shown in FIG. 6A, the door 2 rotates around the pivot pin 17 to close. After further rotation of the door 2, as shown in FIG. 6B, the rotating member 11 comes into contact with the guide pin 5. Next, as shown in FIG. 7A, the depression 11*a* of the rotating member 11 engages with the guide pin 5.

The door 2 is rotated further. The rotating member 11 starts to rotate against the coil spring 14. When the rotation shaft 12 of the rotating member 11 passes over the guide pin 5, the rotating member 11 moves upward around the guide pin 5. At the same time, the whole door 2 moves upward. Since the door 2 moves upward, the pivot pin 17 moves upward along the elongated hole 6 of the printer body 1A. The rotation shaft 12 is disposed at a position such that the rotating member 11 (the door 2) can move upward around the guide pin 5 when the door 2 is closed.

Figure 7B:
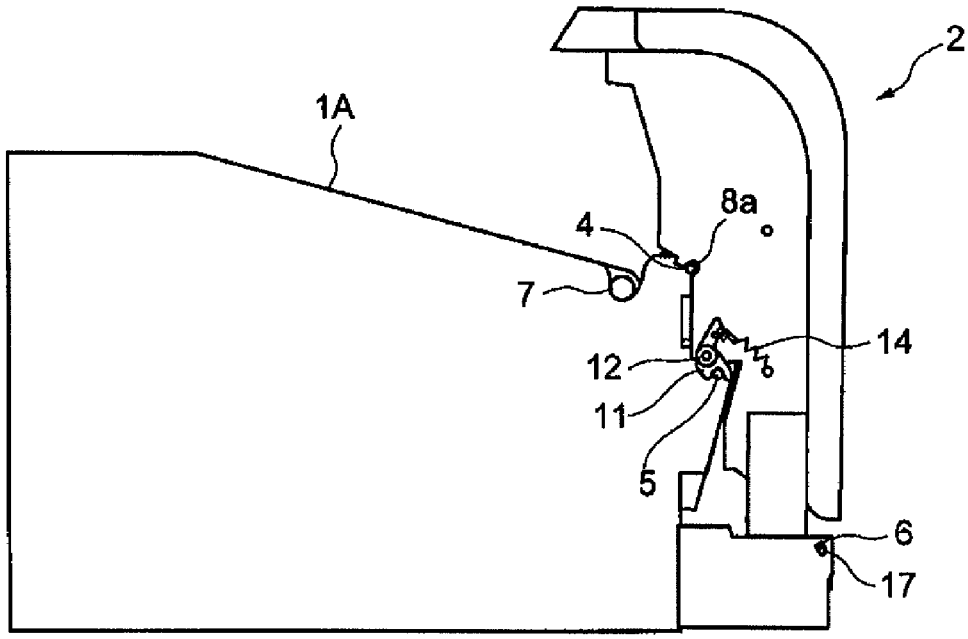

Due to this upward movement of the door 2, as shown in FIG. 7B, the U-shaped depression 8*a* is guided so as to face the engaging pin 4. The door 2 rotates further. After the rotation shaft 12 of the rotating member 11 passes over the guide pin 5, the door 2 moves downward. The U-shaped depression 8*a* also moves downward, from above obliquely towards the engaging pin 4. The engaging pin 4 enters the U-shaped depression 8*a*.

Figure 8:
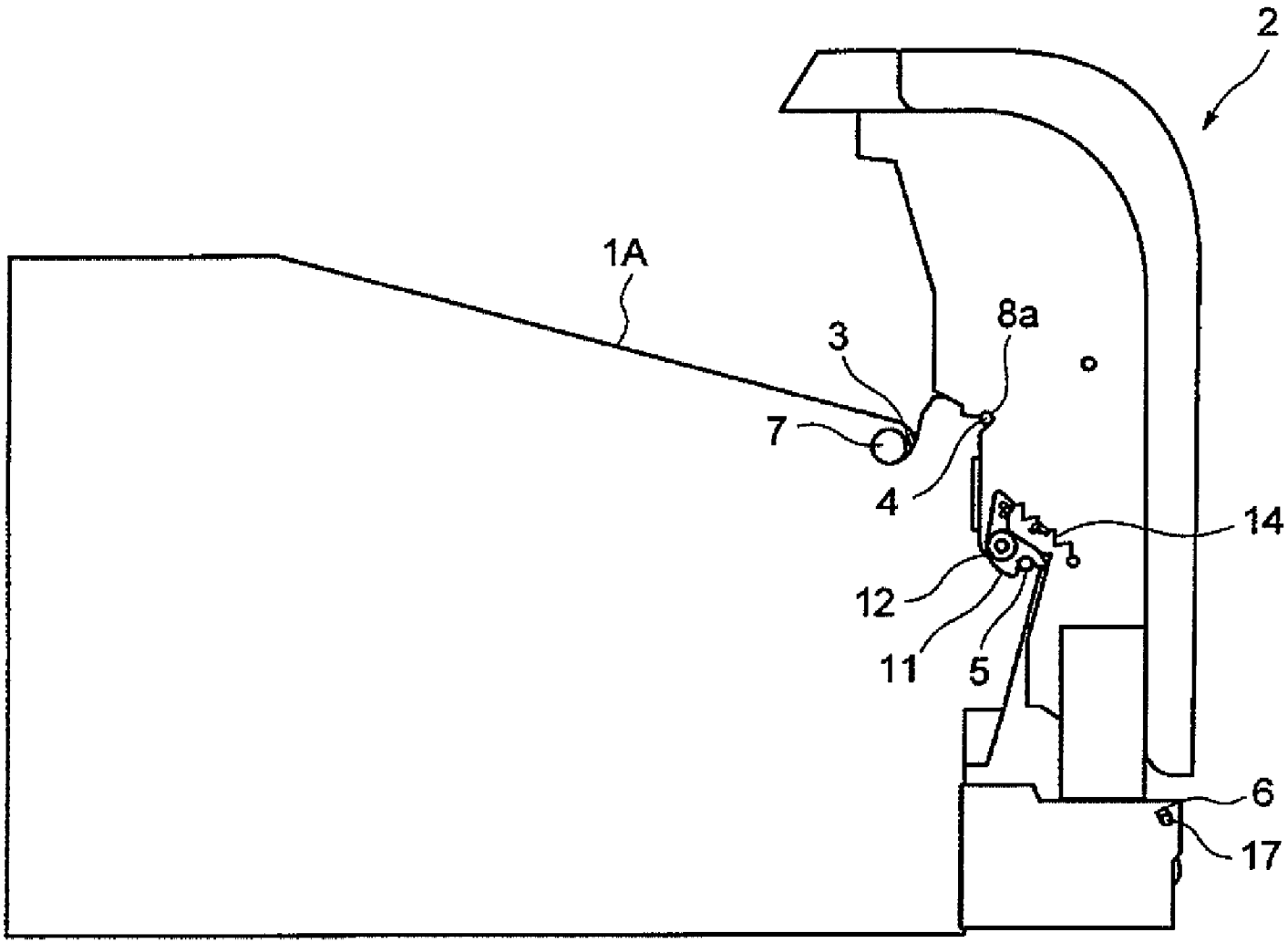
FIG. 8 illustrates how the door of the color laser printer is closed.

Finally, as shown in FIG. 8, the U-shaped depression 8*a* engages with the engaging pin 4. The door 2 is thus positioned horizontally and vertically in relation to the printer body 1A. After the engaging portion 8 engages with the engaging pin 4, the user engages the movable hook 9 with the engaging pin 4 to lock the door 2. The closing operation of the door 2 is thus completed.

At this time, as shown in FIG. 9, the pivot pin 17 is located away from the lower end of the elongated hole 6. Therefore, the weight of the door 2 is put on the engaging pin 4. Being pressed against the engaging pin 4 by the weight of the door 2, the door 2 is positioned. When the door 2 is positioned, the pivot pin 17 in the elongated hole 6 prevents the door 2 from rotating around the engaging pin 4.

That is to say, in the present embodiment, the door 2 is positioned by a positioning device including the engaging pin 4 provided in the printer body 1A, the engaging portion 8 provided in the door 2 and engaging with the engaging pin 4, and a rotation preventing device including the elongated hole 6 and the pivot pin 17 of the door 2. In addition, the rotating member 11 is urged by the coil spring 14 in the direction shown by arrow X in FIG. 4 and pressed against the guide pin 5.

FIG. 9 illustrates the loci of the rotation shaft 12 of the rotating member 11 and the engaging portion 8 when the door 2 is closed. The locus 51 of the rotation shaft 12 includes a first locus 51*a* and a second locus 51*b*. When the door 2 starts to be closed, the rotation shaft 12 describes an arc of a circle whose center is the pivot pin 17 (the first locus 51*a*). Before the door 2 is completely closed, the locus of the rotation shaft 12 curves upward due to the guide pin 5 (the second locus 51*b*). The locus 50 of the engaging portion 8 includes a third locus 50*a* and a fourth locus 50*b*. When the door 2 starts to be closed, the engaging portion 8 describes an arc of another circle whose center is the pivot pin 17 (the third locus 50*a*). Before the door 2 is completely closed, the locus of the engaging portion 8 curves upward due to the upward movement of the rotating member 11 and the movement of the pivot pin 17 along the elongated hole 6 (the fourth locus 50*b*).

By using the guide pin 5 and the rotating member 11 configured as above, the user can lift the door 2 and engage the engaging portion 8 with the engaging pin 4 smoothly. Therefore, even if the door 2 is heavy, the user can close the door 2 easily.

To open the door 2, the user pushes a button (not shown). The link mechanism of the movable hook 9 is activated, and the movable hook 9 rotates around the hook shaft 10 in the direction of arrow Y in FIG. 4. The coil spring 14 exerts a force on the guide pin 5 in the direction of arrow X. As the reaction of this force, a moment in the opening direction around the elongated hole 6 is exerted on the door 2. As a result, the door 2 rotates in the opening direction until it is stopped by the stopper (not shown). Since the door 2 is opened automatically by just pushing the button, the operability can be improved.

In the present embodiment, when the engaging pin 4 engages with the engaging portion 8, the elongated hole 6 prevents only the rotation around the engaging pin 4. Movement of the door 2 in the vertical direction and the horizontal direction is prevented by the engagement between the engaging portion 8 and the engaging pin 4. That is to say, in the present embodiment, positioning of the door 2 in relation to the printer body 1A is performed at the engaging pin 4.

As described above, the engaging pin 4 and the groove 3 are provided in the same member. Therefore, the door 2 engaging with the engaging pin 4 is accurately positioned in relation to the groove 3. Therefore, the sheet conveyance path 70 provided in the door 2 is also accurately positioned in relation to the second transferring roller 63*b* constituting the second transferring unit. Therefore, the sheet P can be conveyed from the sheet conveyance path 70 to a predetermined position in the second transferring unit (second transferring roller 63*b*). As a result, the sheet P does not skew in the printer body, and a defect in the image (e.g., scattering of the image) and deterioration in image quality can be prevented from occurring.

As described above, the door 2 is rotatably provided in the printer body 1A, and at least a part of the sheet conveyance path 70, which conveys the sheet P to the image forming unit 1B, is disposed in the door 2. The positioning device for positioning the door 2 in the vertical direction and the horizontal direction is configured to perform the positioning of the door 2 in the vicinity of the image forming unit 1B (in the vicinity of the second transferring unit, in the present embodiment). Therefore, a sheet jam can be cleared easily. In addition, the whole door 2 can be positioned and aligned accurately. As a result, a defect in the image and deterioration in image quality can be prevented from occurring.

In the present embodiment, a moment in the opening direction around the elongated hole 6 is exerted on the door 2. Alternatively, the direction in which the coil spring 14 exerts a force may be changed, that is to say, a toggle mechanism generating a moment in the closing direction is also suitable. In such a case, the user can close the door 2 easily. In addition, when the door 2 is closed completely, the user can be provided with a clicking sensation. Moreover, when the door 2 is closed completely, the door 2 can be prevented from moving in the opening direction, without using the movable hook 9.

In the foregoing description, the elongated hole 6 is provided in the printer body 1A and the pivot pin 17 (guide shaft) is provided in the door 2. Alternatively, a guide shaft may be provided in the printer body 1A and an elongated hole may be provided in the door 2. In the foregoing description, a toner image formed on a photosensitive drum is transferred to a sheet through an intermediate transferring belt. However, the present invention is not limited to this. The present invention can be applied to an image forming apparatus such that a toner image formed on a photosensitive drum is transferred to a sheet directly.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. An image forming apparatus comprising:

an apparatus body;

an image forming unit configured to form an image on a sheet and disposed in the apparatus body;

a door provided in the apparatus body so as to be openable and closable;

a pivot portion configured to support the door rotatably on the apparatus body; and a positioning device that positions the door and the apparatus body when the door is closed, wherein the pivot portion has a pivot pin provided in one of the apparatus body or the door and an elongated hole extending towards the positioning device provided in the other of the apparatus body or the door, wherein the positioning device has an engaging device provided in the apparatus body and a door engaging device provided in the door, and wherein the door engaging device is engaged to the engaging device from an intersecting direction to an openable and closable direction of the door by sliding of the pivot pin along the elongated hole.

2. The image forming apparatus according to claim 1, wherein the door is moved upward and downward by sliding of the pivot pin along the elongated hole, and the door is moved upward and then downward to engage the engaging device and the door engaging device.

3. The image forming apparatus according to claim 1, wherein the door engaging device is an engaging pin provided in one of the apparatus body or the door and the engaging device is a depression provided in the other of the apparatus body or the door.

4. The image forming apparatus according to claim 3, further comprising a movable hook that engages with the engaging pin and prevents the door from opening.

5. The image forming apparatus according to claim 4, wherein the movable hook prevents the engaging pin from coming out of the depression.

* * * * *